US007300734B2

(12) United States Patent
McDougall et al.

(10) Patent No.: US 7,300,734 B2
(45) Date of Patent: Nov. 27, 2007

(54) TONER COMPOSITIONS

(75) Inventors: Maria N. V. McDougall, Burlington (CA); Richard P. N. Veregin, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 326 days.

(21) Appl. No.: 11/003,256

(22) Filed: Dec. 3, 2004

(65) Prior Publication Data

US 2006/0121381 A1 Jun. 8, 2006

(51) Int. Cl.
*G03G 9/08* (2006.01)

(52) U.S. Cl. ..... 430/108.6; 430/108.3; 430/111.41; 430/137.1; 430/137.14

(58) Field of Classification Search ..... 430/108.6, 430/108.3, 111.41, 137.1, 137.14
See application file for complete search history.

(56) References Cited

U.S. PATENT DOCUMENTS

| | | | | |
|---|---|---|---|---|
| 3,590,000 | A | 6/1971 | Palermilf | |
| 4,558,108 | A | 12/1985 | Alexandru | |
| 4,935,326 | A | 6/1990 | Creatura | |
| 4,937,166 | A | 6/1990 | Creatura | |
| 5,352,556 | A | 10/1994 | Mahabadi | |
| 5,510,220 | A | 4/1996 | Nash et al. | |
| 5,716,751 | A | 2/1998 | Bertrand | |
| 5,916,725 | A | 6/1999 | Patel | |
| 6,021,293 | A * | 2/2000 | Anno et al. | 399/252 |
| 6,087,059 | A | 7/2000 | Duggan | |
| 6,120,967 | A | 9/2000 | Hopper | |
| 6,203,960 | B1 | 3/2001 | Ciccarelli | |
| 6,214,507 | B1 | 4/2001 | Sokol | |
| 6,242,147 | B1 * | 6/2001 | Anno et al. | 430/108.2 |
| 6,379,856 | B2 | 4/2002 | Sokol | |
| 6,451,495 | B1 | 9/2002 | Bayley | |
| 6,503,677 | B1 | 1/2003 | Gutman . | |
| 6,521,297 | B2 | 2/2003 | McDougall | |
| 6,593,049 | B1 | 7/2003 | Veregin | |

* cited by examiner

*Primary Examiner*—Hoa Van Le
(74) *Attorney, Agent, or Firm*—Marylou J. Lavoie, Esq. LLC

(57) ABSTRACT

A toner composition comprising a binder, colorant, and a charge control surface additive mixture comprising a mixture of a first titanium dioxide possessing a first conductivity and a second titanium dioxide possessing a second conductivity and which second conductivity is dissimilar than the first conductivity; wherein the mixture of the first titanium dioxide and the second titanium dioxide is selected in a ratio sufficient to impart a selected triboelectric charging characteristic to the toner composition.

61 Claims, No Drawings

TONER COMPOSITIONS

TECHNICAL FIELD

The present invention relates to toner and developer compositions and more particularly relates to toner and developer compositions having a toner additive mixture for controlling triboelectric charging comprising a first titanium dioxide possessing a first conductivity and a second titanium dioxide possessing a second conductivity that is different from the first conductivity, with the mixture of the first titanium dioxide and the second titanium dioxide selected in a ratio sufficient to impart a selected triboelectric charging characteristic to the composition.

BACKGROUND

The properties of a toner can be established, for example, through the selection of materials such as toner composition and amounts of surface additive materials used to formulate a functional toner. The charging characteristics of a toner are also dependent upon the carrier used in a developer composition, in particular the carrier coating. Toners typically comprise at least a binder resin, a colorant, and one or more external surface additives. The external surface additives are generally added in small amounts. Examples of external surface additives include silica, titanium dioxide, zinc stearate, etc.

For both black and color prints, a small particle size toner is known to improve the image quality of the prints. Due to the physics of small toner particles, particularly due to the large surface area inherent in smaller particles, problems such as high cohesion, poor flow, high charge to mass ratio (Q/m) and low charge to diameter ratio (Q/d) is typical. Problematically, the higher Q/m achieved with smaller particles limits developability, while the lower Q/d achieved with smaller particles increases undesirable background on prints. These issues have been addressed by the use of surface additives.

For example, small sized hydrophobic $SiO_2$ particles can be employed to reduce toner cohesivity and improve flow. Small sized additives also work as charge control agents and may increase the developer Q/m. Toners having a triboelectric charging property within the range of about −30 micro-Coulombs/gram (μC/g) to about −45 μC/g may be achieved when using small sized silica particles as external additives, for example silica particles having average sizes less than 20 nanometers (nm), such as, for example, the materials known as R812 (~7 nm), R805 (~12 nm) and/or R972 (~16 nm) available from Degussa Corporation. However, the developability at areas of low toner area coverage degrades over time. This has been attributed to the small sized additives being impacted into the toner surface over time.

The problems associated with small particle size toners have been addressed by using larger sized additives, i.e., additives having a size of 40 nanometers or larger such as, for example, RX50 silica, RX515H silica, and RY50 silica available from Nippon Aerosil Co. LTD., and/or SMT-5103 titania available from Tayca Corp. However, although certain problems related to developability are addressed, in these cases the toners do not exhibit the proper triboelectric charging ("tribo") required by certain developer systems. Further, for toners employing these larger size particles, it is very difficult to move the developer charging tribo (Q/m) down without compromising the Q/d values and without also exhibiting charge through, i.e., the incumbent toner in the device becomes less negative or even wrong sign, i.e., positive, and the new (fresh) toner added may charge very negative. The most difficult task is to decrease the developer tribo without reducing the charge distribution (Q/d).

U.S. Pat. No. 6,521,297 to McDougall, Veregin, and Moffat, entitled "Marking Material and Ballistic Aerosol Marking Process for the Use Thereof" addresses, among other problems in the art, the issue of channel clogging, and describes a process for depositing marking material onto a substrate which comprises (a) providing a propellant to a head structure, the head structure having a channel therein, the channel having an exit orifice with a width no larger than about 250 microns through which the propellant can flow, the propellant flowing though the channel to form thereby a propellant stream having kinetic energy, the channel directing the propellant stream toward the substrate, and (b) controllably introducing a particulate marking material into the propellant steam in the channel wherein the kinetic energy of the propellant particle stream causes the particulate marking material to impact the substrate and where the particulate marking material comprises (a) toner particles which comprise a resin and a colorant, the particles having an average particle diameter of no more than about 7 microns and a particle geometric size distribution (GSD) equal to no more than about 1.25, the toner particles being prepared by an emulsion aggregation process, and (b) hydrophobic semiconductive metal oxide in combination with silica dioxide particles added by a dry blending process onto the toner particles. In this system, the silica controls the triboelectric charging and toner flow and the mixture of insulative and semiconductive titanium dioxide increases the overall bulk conductivity of the toner and provides excellent resistance to changes associated with relative humidity (RH). It is also known in the art that the incumbent fresh toner must have a very short time to mix with developer inside the developer housing, preferably this charge sharing should occur within about 1 to 2 minutes of mixing, more preferably between 30 to 60 seconds, and most preferably between 5 to 30 seconds.

U.S. Pat. No. 5,510,220, to Nash, Hanzlik, Muller and Hodgson, entitled "Conductive Developer Compositions With Surface Additives" describes a developer composition comprised of negatively charged toner particles comprised of crosslinked polyester resin particles, pigment particles, and a surface additive mixture comprised of metal salts of fatty acids in an amount of from about 0.2 to about 0.5 weight percent, metal oxide particles in an amount of from about 0.3 to about 1 weight percent, and silica particles in an amount of from about 0.2 to about 0.5 weight percent; and carrier particles comprised of a core with a coating thereover containing a conductive component.

U.S. Pat. No. 6,503,677 to Gutman, Grushkin, and Ruhland, entitled "Emulsion Aggregation Toner Particles Coated With Negatively Chargeable and Positively Chargeable Additives and Method of Making Same" describes an emulsion aggregation toner comprised of toner particles comprising polymer binder and colorant and a surface additive package comprising at least titania, at least one negative additive negatively chargeable to a reference carrier, and at least one positive additive positively chargeable to the reference carrier.

U.S. Pat. No. 6,087,059 to Duggan, Henderson, Stamp, Silence, Hollenbaugh, Gutman, Grushkin, and Ruhland, entitled "Toner and Developer Compositions" describes a toner comprised of resin, colorant, and a surface additive mixture comprised of two coated silicas, and a coated metal oxide, wherein the two coated silicas are comprised of a first silica and a second silica, and wherein the first coated silica contains a coating of an alkyl silane and an amino alkyl silane.

U.S. Pat. No. 6,214,507 to Sokol and Gutman entitled "Toner Compositions" describes a toner composition comprised of binder, colorant, and a surface additive of a coated silica and wherein the silica possesses a BET surface area, in $m^2/g$, of from about 35 to about 65, a bulk density, in grams/liter, of from about 40 to about 60, and wherein the size diameter determined from the BET measurement is from about 20 to about 100 nanometers, and wherein the silica is coated with a mixture of γ-aminopropyltriethoxysilane and hexamethyldisilazane, and wherein the silica coated additive is of a size diameter of from about 25 to about 75 nanometers, and wherein the aggregate of the coated silica size diameter is about 225 to about 400 nanometers.

U.S. Pat. No. 6,379,856 to Sokol and Gutman, entitled "Toner Compositions" describes a toner comprised of binder, colorant and a surface additive mixture of a coated silica and a metal oxide, wherein the silica is coated with a mixture of γ-aminopropyltriethoxysilane and hexamethyldisilazane, wherein the metal oxide is titanium dioxide coated with decylsilane, and wherein the silica has a bulk density of from about 40 to about 60 grams/liter.

U.S. Pat. No. 6,203,960 to Ciccarelli, Bayley, and Pickering, entitled "Toner Compositions" describes a toner composition comprised of binder, colorant, and a toner particle surface additive component comprised of a first coated fumed silica surface coated with a first major amount of an alkylsilane compound present in an amount of from about 3 to about 20 weight percent based on the weight of the fumed silica and a second minor amount of an aminoalkylsilane compound present in an amount of from about 3 to about 700 parts per million of basic nitrogen (N:) based on the weight of the fumed silica.

The disclosures of the foregoing are incorporated herein by reference in their entireties.

What is still desired is a toner having a surface additive package to control toner charging, improve developability, and prevent background defects during imaging and printing, as well as improve RH sensitivity of the developer.

SUMMARY OF THE INVENTION

The present invention is directed to a toner composition comprising a binder, colorant, and a charge control surface additive mixture comprising a mixture of a first titanium dioxide possessing a first conductivity and a second titanium dioxide possessing a second conductivity and which second conductivity is dissimilar from the first conductivity; wherein the mixture of the first titanium dioxide and the second titanium dioxide is selected in a ratio sufficient to impart a selected triboelectric charging characteristic to the toner composition. In a preferred embodiment, the first titanium dioxide is an insulative titanium dioxide and the second titanium dioxide is a moderately conductive titanium dioxide. Preferably, each of the first titanium dioxide and the second titanium dioxide possesses a different composition. In another preferred embodiment, the surface additive mixture further includes at least one silica additive, such as, for example, silica dioxide. In yet another preferred embodiment, the toner composition including the surface additive mixture is selected such that the resultant toner is moderately conductive.

The invention is further directed to a developer comprising a toner and a carrier, wherein the toner of the developer comprises toner particles comprising a binder, colorant and a charge control surface additive mixture comprising a first titanium dioxide having a first conductivity and a second titanium dioxide having a second conductivity and which second conductivity is dissimilar than the first conductivity; wherein the mixture of the first titanium dioxide and the second titanium dioxide is selected in a ratio sufficient to effect a desired triboelectric charging characteristic to the composition. Preferably, the developer charge control surface additive mixture further comprises at least one silica additive.

The invention is further directed to a method for preparing a toner comprising forming toner particles comprised of a binder and colorant; and incorporating a charge control surface additive mixture comprising a mixture of a first titanium dioxide possessing a first conductivity and a second titanium dioxide possessing a second conductivity and which second conductivity is dissimilar than the first conductivity; wherein the mixture of the first titanium dioxide and the second titanium dioxide is selected in a ratio sufficient to impart a desired triboelectric charging characteristic to the toner.

The invention is further directed to a method for preparing a developer comprising determining a charging effect a carrier imparts to a toner at a selected concentration of toner to carrier; preparing a charge control surface additive mixture comprising a mixture of a first titanium dioxide possessing a first conductivity and a second titanium dioxide possessing a second conductivity that is different from the first conductivity, wherein a ratio of the first titanium dioxide to the second titanium dioxide is selected based upon the determined charging effect; incorporating the surface additive mixture onto the toner; and mixing the toner and the carrier.

The charge control surface additive mixture provides the advantages of improved charging characteristics, in particular, reduced RH charging sensitivity. The invention provides for reduction of the triboelectric charging and control of the Q/d ratio in a stable developer by use in the surface additive mixture of the selective mixture of the two titanium dioxides. The invention prevents toner clouding and dirt in the prints while printing at high speed. The developer RH sensitivity is very low and stable during printing, the toner flow is exceptionally good and the surface coverage of surface additives on the toner surface reduces toner blocking by providing resistance to caking.

The charge control surface additive mixture comprising a selected mixture of first and second titanium dioxides, for example, insulative and moderately conductive titanium dioxides, advantageously provides for reduction of the developer triboelectric charging Q/m ratio without decreasing the Q/d by narrowing the charge distribution. Thus, by control of the ratio of the first and second titanium dioxides in the mixture, the invention provides improved developability (Q/m), while at the same time preventing background defects (due to low Q/d) during imaging and printing of digital printers.

These and other features and advantages of the invention will be more fully understood from the following description of certain specific embodiments of the invention.

DESCRIPTION OF THE PREFERRED EMBODIMENT

In embodiments of the present invention, a first titanium dioxide comprising an insulative titanium dioxide, such as hydrophobic SMT-5103 (available from Tayca Corp.), is used in the toner additive mixture to decrease toner sensitivity related to changes in environmental conditions such as relative humidity (RH). However, an increased amount of this additive does have a small effect on toner bulk conductivity. In accordance with the invention, it was discovered by the present inventors that a second moderately conductive titanium dioxide, such as STT-100H (IK Inabata America Corporation, New York), has a much greater effect on toner bulk conductivity and at small additive amounts. For example, moderately conductive titanium dioxide in an amount of 1 weight percent provides a stable toner that does not change triboelectric charging when exposed to varying RH conditions. It was further discovered that by combining a first titanium dioxide having a first conductivity and a second titanium dioxide having a second conductivity that is different from the first conductivity at selected ratio amounts, one can increase or decrease the tribo (Q/m) with very small reduction of charge distribution (Q/d). This aspect of the invention comprising controlling both charging parameters is very important in that a high Q/m can limit toner development and cleaning of the photoreceptor while a low Q/d increases the occurrence of undesirable background (dirty images).

The invention is applicable to toners generally and may comprise any toner, such as "conventional" toners, made of a resin/binder, colorant (pigment, dye, etc.), gel, wax, and the like, as known in the art related to xerographic applications. For example, the toners of the present invention can be prepared by mixing, such as by melt mixing, and heating resin particles such as styrene polymers, polyesters, and similar thermoplastic resins, colorant, wax, especially low molecular weight waxes, and charge enhancing additives, or mixtures of charge additives, in a toner extrusion device, such as the ZSK40 and ZSK53 available from Werner Pfleiderer, and removing the formed toner composition from the device. Subsequent to cooling, the toner is subjected to grinding utilizing, for example, a Sturtevant micronizer, reference U.S. Pat. No. 5,716,751, the disclosure of which is totally incorporated herein by reference, for the purpose of achieving toner particles with a volume median diameter of less than about 25 microns, and preferably of from about 4 to about 12 microns, which diameters are determined by a Coulter Counter. Subsequently, the toner compositions can be classified utilizing, for example, a Donaldson Model B classifier for the purpose of removing fines, that is toner particles less than about 5 microns by population. Thereafter, the surface additive mixture and other additives are added by the blending thereof with the toner obtained.

Illustrative examples of suitable toner binders, include toner resins, especially polyesters, thermoplastic resins, polyolefins, styrene acrylates, such as PSB-2700 available from Hercules-Sanyo Inc., styrene methacrylate, styrene butadienes, cross-linked styrene polymers, epoxies, polyurethanes, vinyl resins, including homopolymers or copolymers of two or more vinyl monomers; and polymeric esterification products of a dicarboxylic acid and a diol comprising a diphenol. Vinyl monomers include styrene, p-chlorostyrene, unsaturated mono-olefins such as ethylene, propylene, butylenes, isobutylene, and the like; saturated mono-olefins such as vinyl acetate, vinyl propionate, and vinyl butyrate; vinyl esters like esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; mixtures thereof; and the like, styrene butadiene, reference the U.S. patents mentioned herein, the disclosures of which have been totally incorporated herein by reference. In addition, cross-linked resins, including polymers, copolymers, and homopolymers of the aforementioned styrene polymers, may be selected.

As one toner resin, there are selected the esterification products of a dicarboxylic acid and a diol comprising a diphenol. These resins are illustrated in U.S. Pat. No. 3,590,000, the disclosure of which is totally incorporated herein by reference. Other specific toner resins include styrene/methacrylate copolymers, and styrene/butadiene copolymers; Pliolites, suspension polymerized styrene butadienes, reference U.S. Pat. No. 4,558,108, the disclosure of which is totally incorporated herein by reference; polyester resins obtained from the reaction of bisphenol A and propylene oxide, followed by the reaction of the resulting product with fumaric acid; and branched polyester resins resulting from the reaction of dimethylterephthalate, 1,3-butanediol, 1,2-propanediol, and pentaerythritol, reactive extruded resin, especially reactive extruded polyesters with cross-linking as illustrated in U.S. Pat. No. 5,352,556, the disclosure of which is totally incorporated herein by reference, styrene acrylates and mixtures thereof.

The resin is present in a sufficient, but effective amount, for example from about 50% by weight to about 98% by weight, preferably from about 75% by weight to about 95% by weight, based upon the total weight of the composition.

In a preferred embodiment, the toners of the present invention are emulsion aggregation toners. That is, the toner particles of the toner, which comprise at least a polymer binder and a colorant, are derived via known emulsion aggregation techniques. The toner particles may be characterized as aggregated and coalesced toner particles as a result of the emulsion aggregation formation process.

Preferably, two main types of emulsion aggregation toners may be used herein. First is an emulsion aggregation toner prepared by a process that forms acrylate based, e.g., styrene acrylate, toner particles and in which surfactants are used in forming the latex emulsion. See, for example, U.S. Pat. No. 6,120,967 to Hopper, Patel, Rettinger, and Martin entitled "Sequenced Addition of Coagulant in Toner Aggregation Process," which is hereby incorporated by reference herein in its entirety, as one example of such a process. Second is an emulsion aggregation toner prepared by a process that forms polyester, e.g., sodio sulfonated polyester, and which is a surfactant-free process. See, for example, U.S. Pat. No. 5,916,725 to Patel, Mychajlowskij, Foucher, Sacripante, and Ong entitled "Surfactant Free Toner Processes," which is hereby incorporated by reference herein in its entirety, as one example of such a process.

Briefly, emulsion aggregation techniques typically involve the formation of an emulsion latex of the resin particles, which particles have a small size of from, for example, about 5 to about 500 nanometers in diameter, by heating the resin, optionally with solvent if needed, in water, or by making a latex in water using an emulsion polymerization. A colorant dispersion, for example of a pigment dispersed in water, optionally also with additional resin, is separately formed. The colorant dispersion is added to the emulsion latex mixture, and an aggregating agent or complexing agent is then added to form aggregated toner particles. The aggregated toner particles are heated to enable coalescence, thereby achieving coalesced, aggregated toner particles.

Emulsion aggregation techniques achieve aggregated toner particles that are able to have a desirable small average particle size without requiring mechanical grinding, and that have excellent size distribution without requiring extensive screening operations to remove particles that are too large or too small. Those embodiments of the invention comprising aggregated toner particles preferably have a volume average diameter of from about 1 to about 15 microns, preferably from about 1 to about 10 microns, and more preferably from about 3 to about 9 microns, and a narrow geometric size distribution (GSD) of, for example, from about 1.05 to about 1.25, preferably from about 1.05 to about 1.20, as measured on a Coulter Counter. As the resin of the emulsion aggregation toners, any resin amenable to use in the emulsion aggregation method may be selected without limitation, numerous suitable examples being identified in the above-mentioned patents. Appropriate aggregating or complexing agents for use in aggregating the selected resin may also be selected as described in any of these patents.

The colorant may be, for example, dyes, pigments, mixtures thereof, mixtures of pigments, mixtures of dyes, and the like, although the use of pigments and pigment mixtures is preferred. The colorant may have a color of, for example, black (e.g., carbon black), cyan, yellow, magenta, blue, or mixtures thereof. The colorant preferably has a mean colorant size ranging from about 50 to about 150 nanometers.

Various known colorants such as dyes or pigments are present in the toner in an effective amount of, for example, from about 1 to about 25 percent by weight based upon the weight of the toner composition, and preferably in an amount of from about 1 to about 15 percent by weight based upon the weight of the toner composition.

Colorants that may be used include magnetites such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYERROX 8600™, 8610™; Northern Pigments magnetites, NP-604™, NP-608™; Magnox magnetites TMB-100™, or TMB-104™. A suitable black pigment that may be used is, for example, carbon black such as REGAL 330™ and the like. As colored pigments, there can be selected pigments of cyan, magenta, yellow, red, green, brown, blue, or mixtures thereof. Specific examples of pigments include phthalocyanine HEILIOGEN BLUE L6900™, D6840™, D7080™, D7020™, PYLAM OIL BLUE™, PYLAM OIL YELLOW™, PIGMENT BLUE 1™, available from Paul Uhlrich & Company, Inc.; PIGMENT RED 48™, LEMON CHROME YELLOW DCC1026™, E.D. TOLUIDINE RED, and BON RED C™, available from Dominion Color Corporation, Ltd., Toronto, Ontario; NOVAPERM YELLOW FGL™, HOSTAPERM PINK E™, available from Hoechst; and CINQUASIA MAGENTA™, available from E.I. DuPont de Nemours & Company, and the like. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan pigments include copper tetra (octadecyl sulfonamide) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetamilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. The colorant may also be comprised of a predispersed pigment such as are commercially available. Example preferred pigment dispersions include the FLEXIVERSE series and the SUNSPERSE series of pigment dispersions from Sun Chemical. Some of these are Blue 15:3 (BFD-1121), Blue 15 (BFD-1149), Blue 61 (BFD-9516), Red 81:2 (RFD 9664), Red 22 (RFD-4241), Yellow 14 (YFD-1123), Yellow 17 (YFD-4249), Black Regal 660 (LFD-4343), Green 7 (GFD-1151), Green 36 (GFD-7114), Violet 19 (QFD-1180) and Violet 23 (VFD-1157).

In addition to the resin and colorant, there can be included in the toner compositions additives in various effective amounts including waxes, such as waxes with a molecular weight $M_w$ weight average molecular weight of, for example, from about 1,000 to about 20,000, such as polyethylene, polypropylene, and paraffin waxes, which can be included in or on the toner compositions as fuser roll release agents. Specific examples include polypropylenes and polyethylenes commercially available from Allied Chemical and Petrolite Corporation, EPOLENE N-15 commercially available from Eastman Chemical Products, Inc., VISCOL 550-P, a low weight average molecular weight polypropylene available from Sanyo Kasei K. K., and the like. The wax may be present in the toner composition in various amounts; however, generally these waxes are present in the toner composition in an amount of from about 1 percent by weight to about 15 percent by weight, and preferably in an amount of from about 2 percent by weight to about 10 percent by weight. The toners may also include polymeric alcohols, such as UNILINS available from Petrolite Corporation.

In embodiments, the toners of the present invention comprise a polymer binder, colorant, and a charge control surface additive mixture comprising a mixture of a first titanium dioxide having a first conductivity, such as an insulative titanium dioxide, and a second titanium dioxide having a second conductivity that is different from the first conductivity, such as a moderately conductive titanium dioxide, wherein the mixture of the first titanium dioxide and the second titanium dioxide is selected in a ratio sufficient to effect a desired triboelectric charging characteristic to the composition. In a preferred embodiment, each of the first titanium dioxide and the second titanium dioxide possess a different level of conductivity and a different composition. In another preferred embodiment, the toner surface additive mixture further comprises at least one silica additive.

In yet another preferred embodiment, the toner and/or the toner surface additive mixture further include a conductivity aid, for example a metal salt of a fatty acid such as zinc stearate. A suitable example includes Zinc Stearate L from Ferro Corp. Such a conductivity aid may be present, for example, in an amount of from about 0.10% to about 1.00% by weight of the toner.

In developer compositions, it is desired that toner freshly added to a device rapidly gain charge to the same level as that of the incumbent toner in the developer. If this is not the case, two distinct situations may occur. When freshly added toner fails to rapidly charge to the level of the toner already in the developer, a situation known as "slow admix" occurs. Distributions can be bimodal in nature, meaning that two distinct charge levels exist side-by-side in the development subsystem. In extreme cases, freshly added toner that has no net charge or wrong sign charge may be available for development onto the photoreceptor. Conversely, when freshly added toner charges to a level higher than that of toner already in the developer, a phenomenon known as "charge through" occurs. Also characterized by a bimodal distribution, in this case the low charge or wrong sign polarity toner is the incumbent toner (or toner that is present in the developer prior to the addition of fresh toner). The failure modes for both slow admix and charge through are most notably background and contamination of machine subsystems, wire history, interactivity, and poor text and graphic quality.

It has been found by the present inventors that through the appropriate selection of a surface additive mixture that includes at least a mixture of a first titanium dioxide possessing a first conductivity and a second titanium dioxide possessing a second conductivity that is different from the first conductivity, and preferably further including silica and zinc stearate, maintenance of developer Q/d is achieved while at the same time decreasing the Q/m ratio of the developer. The toner compositions in accordance with the invention may contain components, for example, including dyes, pigments, organic finely divided power, charge controlling agents, hydrophobic silica, conductive titanium oxide, and the like, in addition to the binder resin. The hydrophobic silica and the conductive titanium dioxide have the effect of, respectively, improving the fluidity of the toner composition and improving the uniformity of the toner charging.

Hydrophobic silica suitable for use in the present invention includes, but is not limited to, silica subjected to surface treatment using for example, a material selected from the group consisting of a silane, decyltrimethoxysilane, dimethyldichlorosilane (HMDS), dimethyl polysiloxane, hexamethyldisilazine, amino-silane, and amine. Examples of commercially available silica products include, but are not limited to, H2000, H3004, manufactured by Wacker-Chemie GmbH, and the like, and R974, RY200, RX200, RX300, RA200H, REA200, RY50, NA50HS, and the like, manufactured by Nippon Aerosil Co., Ltd. The hydrophobic silica may be present in any effective amount. Preferably, the hydrophobic silica is present in an amount of from about 1% by weight to about 6% by weight, more preferably from about 2% by weight to about 4% by weight, based upon the weight of the toner particles.

With respect to the moderately conductive titanium dioxide component, it is preferable that the titanium dioxide undergo a surface treatment such as with a silane. Examples of suitable surface treatments include, but are not limited to, silane, decylsilane, decyltrimethoxysilane, dimethyldichlorosilane, dimethyl polysiloxane, hexamethyldisilazine, amino silane, i-butyltrimethoxy silane, silicone oil or a combination thereof. For example, in one preferred embodiment, the moderately conductive titanium dioxide component is surface treated with about 16% to about 33% of i-butyltrimethoxy silane (i-BTMS).

By moderately conductive titanium dioxide, it is meant that the titanium dioxide particles have an average bulk conductivity in the range of from about 10E-6 (E=exponent, so that 10E-6 equals $1\times10^{-6}$) to about 10E-12 S/cm, in the range of from about 10E-7 to about 10E-10 S/cm, or in the range of from about 10E-8 to about 10E-9 S/cm. In a preferred embodiment, the moderately conductive titanium dioxide has a conductivity range of 10E-7 to 10E-10 Siemens per centimeter (S/cm), such as a moderately conductive titanium dioxide selected from the group consisting of STT-100H, STT-100HFS20, STTA11-FS10, STT-A11, and STT-30A, manufactured by Titan Kogyo Kabushiki Kaisha, Tokyo-Japan (IK Inabata America Corporation, New York). Other examples of suitable moderately conductive titanium dioxide include, but are not limited to, EC-100, EC-210, EC-300, commercially available from Titan Kogyo Kabushiki Kaisha, Tokyo-Japan (IK Inabata America Corporation, New York).

The second titanium dioxide is preferably a moderately conductive titanium dioxide charge additive having an average primary particle diameter of at least about 10 nanometers to about 100 nanometers. (The term "average primary particle diameter" is used herein to refer to individual primary titanium dioxide particles, which are to be distinguished from particle aggregates, which can occur when two or more primary particles aggregate, and form particle agglomerates, which can occur when two or more aggregates agglomerate. Primary particle size can be distinguished by, for example, scanning electron microscopy).

Preferably, the developer has a toner charge to mass ratio of from about −60 to about −10 micro Coulombs per gram (μC/g), more preferably from about −30 to about −20 μC/g, and most preferably from about −25 to about −15 μC/g.

The first titanium dioxide is preferably an insulative titanium dioxide possessing an average primary particle diameter of at least about 10 nanometers to about 100 nanometers. By insulative titanium dioxide, it is meant that the titanium dioxide particles have an average bulk conductivity of less than or equal to about 10E-15 S/cm, less than or equal to about 10E-14 S/cm, or less than or equal to about 10E-11 S/cm. "Average bulk conductivity" refers to the ability for electrical charge to pass through a pellet (1 mm thick) of the metal oxide particle measured when the pellet is placed between two electrodes. Preferably, the first titanium dioxide is an insulative titanium dioxide possessing an average bulk conductivity of about 10E-11 S/cm to about 10E-15 S/cm.

In a most preferred embodiment, the surface additive mixture includes a mixture of two titanium dioxides, one insulative and one moderately conductive, such as, for example SMF-5103 and STT-100H. SMT-5103, a titania having a particle size of about 25 to about 55 nanometers treated with decylsilane and insulative at $10^{-13}$ S/cm, is available from Tayca Corp. STT-100H, a titania having a particle size of about 20 to about 60 nanometers and moderately conductive at $10^{-8}$ S/cm, along with, for example, STT-100HF20, STT 100H, STTA11-FS10, STT A11, STT 30A are available from Titan Kogyo Kabushiki Kaisha, Tokyo, Japan (IK Inabata America Corporation, New York).

It has been found that slightly increasing toner conductivity narrows the toner charge distributions producing sharp peaks with very narrow widths. In addition, a small increase in toner conductivity remarkably improves the admixing time of fresh toner that is constantly in demand during printing. With the addition of the surface additive mixture, the toner of the present invention preferably comprises a conductivity of from about 10E-12 S/cm to about 10E-16 S/cm, more preferably from about 10E-10 S/cm to about 10E-14 S/cm, and most preferably from about 10E-8 S/cm to about 10E-10 S/cm.

The ratio of the mixture of the at least one insulative titanium dioxide to the at least one moderately conductive titanium dioxide in the additive package is selected to comprise a ratio suitable for the specific imaging application. For example, the at least one insulative titanium dioxide and the at least one moderately conductive titanium dioxide may be present in the surface additive package in a ratio of from about 15:85 to about 25:75, from about 50:50 to about 85:15 or at a ratio of about 75:25 based on the total weight of the at least one insulative titanium dioxide and the at least one moderately conductive titanium dioxide. Further, for example, the surface additive mixture may include from about 8% to about 3%, or from about 6% to about 4%, by weight of the toner composition, of the at least one insulative titanium dioxide and from about 1% to about 4.5%, or from about 0.5% to about 2.5%, by weight of the toner composition, of the at least one moderately conductive titanium dioxide.

In an important aspect of the invention, the ratio of the mixture of the first titanium dioxide to the second titanium dioxide is selected or "tuned" with respect to a given carrier coating. That is, the optimal ratio range of insulative additive to moderately conductive additive is selected for a particular carrier coating. In general, for more "positive" carriers, i.e., for carriers having coatings that impart a greater negative charge to a toner, more moderately conductive titanium dioxide should be present in the additive mixture. Accordingly, in the process of formulating an optimal charge control additive mixture for a toner of a developer, the charging effect, e.g., the level of charging and admix time, that the carrier of the developer imparts to the toner at the selected concentration of toner to carrier is determined, and then the surface additive mixture comprised of a mixture of the first titanium dioxide having a first conductivity and the second titanium dioxide having a second conductivity that is different form the first conductivity, is prepared, the ratio of the first titanium dioxide to the second titanium dioxide being selected (derived) based upon the determined charging effect.

The toners of the present invention are toners, most preferably emulsion aggregation toners, comprising polymer binder and colorant, and having a surface additive package as described herein. The invention is applicable to many developer products where there is a need to maintain a low Q/m to allow development, with a narrow Q/d to achieve clean images. The invention is particularly suitable for emulsion aggregation toners, such as, for example, 5.7 micron emulsion aggregation toner, although the invention is also application to toners generally including, but not limited to, conventional toners.

The advantages provided by this invention include, but are not limited to: (1) Reduction of toner Q/m to improve developability, without reduction of Q/d charge distribution, thereby allowing maintenance of good background; (2) Reduction of the width of toner charge distributions; (3) Improvement of toner RH sensitivity; and (4) Improvement of toner admixing to maintain print quality at higher print speed.

The toners are made by first forming the particles thereof, such as by emulsion aggregation, and then the surface additive mixture and any other additives are incorporated onto the aggregated particles, for example by the blending thereof with the particles obtained. The overall coating weight of the additive mixture, based on the weight of the toner composition, is, for example, from about 1% to about 10% by weight, and preferably from about 5% to about 8% by weight.

Developer compositions are prepared by mixing the toner of the present invention with known carrier particles, including coated carriers, such as steel, ferrites, and the like, reference U.S. Pat. Nos. 4,937,166 and 4,935,326, the disclosures of which are incorporated by reference herein in their entireties, in amounts such as, for example, from about 2 weight percent toner concentration to about 8 weight percent toner concentration. The carriers can include coatings thereon, such as those illustrated in the U.S. Pat. Nos. 4,937,166 and 4,935,326, and other known coatings. There can be selected a single coating polymer, or a mixture of polymers. Additionally, the polymer coating, or coatings, may contain conductive components therein, such as carbon black, in an amount, for example, of from about 10 to about 70 weight percent, and preferably from about 20 to about 50 weight percent. Specific examples of coatings are fluorocarbon polymers, acrylate polymers, methacrylate polymers, silicone polymers, polyurethanes, and the like. Preferably, a concentration of the toner in the developer is from about 10% to about 3% percent.

The following examples are being supplied to further define the present invention, it being noted that these examples are intended to illustrate and not limit the scope of the present invention.

EXAMPLES

The advantages of the present invention were demonstrated comparing a control with only insulative titanium dioxide (SMT 5103) to mixtures with different ratios of insulative titanium dioxide (SMT-5103) to moderately conductive titanium dioxide (STT-100H). It was found that developer stability is not compromised by mixing the two forms of $TiO_2$.

The carriers used in the following examples to further illustrate the invention and preferred embodiments thereof comprised an irregular steel core, approximately 65 microns in diameter, obtained from Hoeganaes Corporation, and having a 1% by weight polymethylmethacrylate and carbon black coating disposed thereover.

Toners for each example were prepared by blending 50 g of emulsion aggregation toner (referred to in the Examples as "EA toner") comprising styrene/n-butyl acrylate/beta-carboxyl ethyl acrylate (CEA) binding resin as disclosed in commonly assigned, co-pending patent application Ser. No. 11/003,582, published Jun. 8, 2006, Publication No. 20060121384, which is hereby incorporated by reference herein in its entirety, with each of $SiO_2$, $TiO_2$ and zinc stearate at the wt % specified for each example using a small lab blender for 30 seconds at a speed of 13500 RPM.

Comparative Example 1

50 g toner of EA toner and 10% carbon black pigment having a surface additive package comprising 2.3 wt % hydrophobic $SiO_2$ with a surface treatment of decyltrimethoxysilane available from Cab-O-Sil division of Cabot Corp., 3.4 weight % SMT-5103 titanium dioxide having a size of about 25 to about 55 nm treated with decylsilane, insulative at $10^{-13}$ S/cm, from Tayca Corp., 0.25 weight % zinc stearate, and 1.2% X24 ultra large sol gel silica from Shin-Etsu Corporation (Ratio-100% SMT-5103).

Example 2

50 g of EA toner and 10% carbon black pigment having a surface additive package comprising 2.3 wt % hydrophobic $SiO_2$ with a surface treatment of decyltrimethoxysilane available from Cab-O-Sil division of Cabot Corp., 3.4% weight percent of a 75:25 ratio mixture of SMT-5103:STT-100H, STT-100H, being a titania having a size of about 30 nm to about 100 nm, moderately conductive at $10^{-8}$ S/cm, available from Titan Kogyo Kabushiki Kaisha, Tokyo, Japan (IK Inabata America Corporation, New York), 0.25 weight % zinc stearate, and 1.2 weight % X-24.

Example 3

50 g of EA toner and 10% carbon black pigment having a surface additive package comprising 2.3 w % hydrophobic $SiO_2$ with a surface treatment of decyltrimethoxysilane available from Cab-O-Sil division of Cabot Corp., 3.4 weight % of a 50:50 ratio mixture of SMF-5103:STT-100H, 0.25 weight % zinc stearate, and 1.2 weight % X-24.

Example 4

50 g of EA toner and 10% carbon black pigment having a surface additive package comprising 2.3 wt % hydrophobic $SiO_2$ with a surface treatment of decyltrimethoxysilane available from Cab-O-Sil division of Cabot Corp., 3.4 weight % of a 25:75 ratio mixture of SMT-5103:STT-100H, 0.25 weight % zinc stearate, and 1.2 weight % X-24.

The developers of Comparative Example 1 and Examples 2-4 were prepared by mixing 96 g of carrier with 4 g of toner to prepare 100 grams of developer at 4% toner concentration. The developers were conditioned in A Zone (85% RH and 28° Celsius) and C Zone (15% RH and 10° Celsius) overnight. After conditioning for 12 hours, the developers were paint shaken for 30 minutes.

A 0.5 g sample of developer was used to measure the Q/m ratio in micro Coulombs/g by total blow off using a Faraday cage and to measure the Q/d in fempto Coulombs/micron using a Xerox Charge Spectrograph.

The triboelectric charging evaluation results for Comparative Example 1 and Examples 2-4 are shown in Table 1. In both A and C zones, a moderately conductive titanium dioxide (STT-100H) has a strong effect on Q/m, Q/d and width of the charge distribution. Examples 3 and 4 illustrate how raising the amount of the moderately conductive $TiO_2$ can be detrimental to developer performance and result in increased charging reduction.

TABLE 1

| | Q/m C Zone | Q/m A Zone | C/A ratio | Q/d C Zone | Q/d A Zone |
|---|---|---|---|---|---|
| Comp. Ex. 1 | | | | | |
| 3.4 g (100%) SMT5103 | −21.5 | −13 | 1.7 | −0.37 | −0.18 |
| Example 2 | | | | | |
| 2.55 g (75%) SMT5103: 0.85 g (25%) STT100H | −16.7 | −12.8 | 1.3 | −0.35 | −0.17 |
| Example 3 | | | | | |
| 1.4 g (50%) SMT5103: 1.4 g (50%) STT100H | −13.8 | −13.8 | 1 | −0.26 | −0.09 |
| Example 4 | | | | | |
| 0.85 g (25%) SMT5103: 2.55 g (75%) STT100H | −12.4 | −10 | 1.2 | −0.22 | −0.09 |

The toner of Example 2 wherein the ratio of insulative to moderately conductive titanium dioxide was 75:25, i.e., 75% SMT-5103 (insulative, $\sigma=10^{-13}$ S/cm) and 25% STT-100H (moderately conductive, $\sigma=10^{-8}$ S/cm) achieved excellent charging results providing a developer with controlled reduced charge in C zone, unchanged charging in A zone and a 25% reduction in toner RH sensitivity.

Comparative Examples 5 and 6

Two toner blends including 50 g of EA toner and 10% carbon black pigment were prepared with 1 and 4.5 wt % SMT 5103, respectively, using a small lab blender for 30 seconds at a speed of 13500 RPM. A developer comprising a 65 micron carrier coated with 1% polymethylmethacrylate and carbon black pigment was prepared at 4% toner concentration and conditioned in a low RH and low temperature zone (that is, C zone 10% RH/15° C.) and a high RH-high temperature zone (that is, A zone 85% RH/28° C.) chamber for at least 12 hours and no longer than 18 hours. After conditioning, the developer was charged using a Paint Shaker (Red Devil Model 5400×2 at 664 cycles per minutes). The toner tribo was measured using the total blow off apparatus also known as a Barbetta box. The toner RH sensitivity was calculated as the ratio of Q/m C zone divided by Q/m A zone. Results are shown in Table 2.

TABLE 2

| | % Cohesion | Q/m A zone | Q/m C zone | RH Sensitivity | Toner Bulk Conductivity (S/cm) |
|---|---|---|---|---|---|
| Toner blend 5 1% SMT5103 | 100 | −7.4 | −28.8 | 3.9 | 1.8E-13 |
| Toner blend 6 4.5% SMT5103 | 38.7 | −15.7 | −15.8 | 1.0 | 5.4E-12 |

To illustrate the effect of STT-100H on toner tribo, flow and conductivity, Comparative Examples 7 and 8 comprising toner blend 7 (1% STT-100H) and toner blend 8 (4.5% STT-100H) were prepared. The same procedure as described in the Comparative Examples 5 and 6 was employed to prepare toner blends 7 and 8. Referring to Table 1, employing only SMT-5103 (Comparative Example 1), an RH sensitivity of 1 can only be achieved at high loadings of $TiO_2$, with the % cohesion remaining very high. This is not desirable due to increase on toner cost and poor performance of the developer during printing. Referring to Table 3, an RH sensitivity of 1 is reached with 1% STT-100H and the toner % cohesion is much better than Comparative Example 1 at the same loading. The toner conductivity has improved from 10E-13 to 10E-11. At 1% STT-100H loading (Toner Blend 7), low cohesion and the same tribo is achieved as with 4.5 times more SMT-5103 (Comparative Example 1).

TABLE 3

| | % Cohesion | Q/m A zone | Q/m C zone | RH Sensitivity | Toner Bulk Conductivity (S/cm) |
|---|---|---|---|---|---|
| Toner blend 7 1% STT-100H | 25 | −30.0 | −30.5 | 1.0 | 1.3E-11 |
| Toner blend 0 4.5% STT100H | 2.2 | −10.2 | −13.0 | 0.8 | 4.8E-10 |

Examples 9, 10, 11, and 12

Developer compositions comprising a mixture of 2.3% hydrophobic $SiO_2$ (~30 nm size coated with decyltrimethoxysilane), 3.4% $TiO_2$ comprising mixtures of insulative SMT-5103 and moderately conductive 30 nm STT-100H and 0.25% zinc stearate were prepared and tested in accordance with the procedures as detailed above. Results are shown in the Table 4 below.

TABLE 4

| Examples | Q/m μC/g C Zone | Q/m μC/g A Zone | RH Sensitivity | % Cohesion | Q/dfC/μ C Zone | Q/dfC/μ A Zone |
|---|---|---|---|---|---|---|
| Example 9 | −21.5 | −13 | 1.7 | 20 | −0.37 | −0.18 |
| 2.3% Hydrophobic $SiO_2$<br>3.4% Insulative $TiO_2$<br>0.25% ZnSt | | | | | | |
| Example 10 | −16.7 | −12.8 | 1.3 | 12 | −0.35 | −0.17 |
| 2.3% Hydrophobic $SiO_2$<br>3.4% Mixture 1 of two $TiO_2$<br>0.25% ZnSt | | | | | | |
| Example 11 | −13.8 | −13.8 | 1.0 | 6 | −0.26 | −0.09 |
| 2.3% Hydrophobic $SiO_2$<br>3.4% Mixture 2 of two $TiO_2$<br>0.25% ZnSt | | | | | | |
| Example 12 | −12.4 | −10 | 1.2 | 5 | −0.22 | −0.09 |
| 2.3% Hydrophobic $SiO_2$<br>3.4% Mixture 3 of two $TiO_2$<br>0.25% ZnSt | | | | | | |

Mixture 1: Comprises 75% of insulative $TiO_2$ and 25% moderately conductive $TiO_2$
Mixture 2: Comprises 50% of insulative $TiO_2$ and 50% moderately conductive $TiO_2$
Mixture 3: Comprises 25% of insulative $TiO_2$ and 75% moderately conductive $TiO_2$ While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

The invention claimed is:

1. A composition comprising a binder, colorant, and a charge control surface additive mixture comprising a mixture of a first titanium dioxide possessing a first conductivity and a second titanium dioxide possessing a second conductivity and which second conductivity is dissimilar than the first conductivity;

wherein the mixture of the first titanium dioxide and the second titanium dioxide is selected in a ratio sufficient to impart a selected triboelectric charging characteristic to the toner composition.

2. The composition in accordance with claim 1, wherein the first titanium dioxide is insulative and the second titanium dioxide is moderately conductive.

3. The composition in accordance with claim 1, wherein the first titanium dioxide is an insulative titanium dioxide possessing an average bulk conductivity of less than or equal to about 10E-11 S/Cm.

4. The composition in accordance with claim 1, wherein the first titanium dioxide is an insulative titanium dioxide possessing an average bulk conductivity of about 10E-11 S/cm to about 10E-15 S/cm.

5. The composition in accordance with claim 1, wherein the second titanium dioxide is a moderately conductive titanium dioxide possessing an average bulk conductivity of from about 10E-6 to about 10E-12 S/cm.

6. The composition in accordance with claim 1, wherein the second titanium dioxide is a moderately conductive titanium dioxide possessing an average bulk conductivity of from about 10E-7 to about 10E-10 S/cm.

7. The composition in accordance with claim 1, wherein the additive mixture further comprises:

silica dioxide.

8. The composition in accordance with claim 1, wherein the additive mixture further comprises:

a metal salt of a fatty acid.

9. The composition in accordance with claim 1, wherein the additive mixture further comprises:

zinc stearate.

10. The composition in accordance with claim 1, wherein the toner is moderately conductive.

11. The composition in accordance with claim 1, wherein the toner possesses a conductivity of from about 10E-8 S/cm to about 10E-10 S/cm.

12. The composition in accordance with claim 1, wherein the toner possesses a conductivity of from about 10E-8 S/cm to about 10E-10 S/cm.

13. The composition in accordance with claim 1, wherein the additive mixture further comprises:

at least one hydrophobic silica optionally present in an amount of from about 1 percent to about 6 percent by weight, based upon the weight of the toner particles.

14. The composition in accordance with claim 1, wherein the additive mixture further comprises:

at least one hydrophobic silica surface treated with a material selected from the group consisting of a silane, decyltrimethoxysilane, dimethyldichlorosilane, dimethyl polysiloxane, hexamethyldisilazine, amino-silane, and amine.

15. The composition in accordance with claim 1, wherein the second titanium dioxide is surface treated with a silane.

16. The composition in accordance with claim 1, wherein the second titanium dioxide is surface treated with a decylsilane, decyltrimethoxysilane, dimethyldichlorosilane, dimethyl polysiloxane, hexamethyldisilazine, amino silane, i-butyltrimethoxy silane, silicone oil or mixtures thereof.

17. The composition in accordance with claim 1, wherein the first titanium dioxide and the second titanium dioxide comprise titanium dioxide particles having an average primary particle diameter of at least about 10 nanometers to about 100 nanometers.

18. The composition in accordance with claim 1, wherein the additive mixture comprises from about 8% to about 3% or from about 6% to about 4%, by weight of the composition, of the first titanium dioxide; and further wherein the additive mixture comprises from about 1% to about 4.5% or from about 0.5% to about 2.5%, by weight of the composition, of the second titanium dioxide.

19. The composition in accordance with claim 1, wherein the toner is generated by emulsion aggregation processes.

20. The composition in accordance with claim 1, wherein the colorant is a pigment, a dye, a mixture of pigments, a mixture of dyes, or a combination thereof.

21. The composition in accordance with claim 1, wherein the colorant is carbon black, cyan, magenta, yellow, blue, or mixtures thereof.

22. The composition in accordance with claim 1, wherein the binder is selected from the group consisting of polyesters, thermoplastic resins, polyolefins, styrene acrylate, styrene butadienes, cross-linked styrene polymers, epoxies, polyurethanes, vinyl resins, polymeric esterificatin products of a dicarboxylic acid and a diol comprising a phenol, and copolymers and mixtures thereof.

23. The composition in accordance with claim 1, wherein the additive mixture is present in an amount of from about 1% by weight to about 10% by weight based upon the total weight of the composition.

24. The composition in accordance with claim 1, wherein the additive mixture is present in an amount of from about 5% by weight to about 8% by weight based upon the total weight of the composition.

25. The composition in accordance with claim 1, wherein the binder is present in an amount of from about 50% by weight to about 98% by weight based upon the total weight of the composition.

26. The composition in accordance with claim 1, wherein the binder is present in an amount of from about 75 percent by weight to about 95 percent by weight based upon the total weight of the composition.

27. The composition in accordance with claim 1, wherein the colorant is present in an amount of from about 1% by weight to about 25% by weight based upon the total weight of the composition.

28. The composition in accordance with claim 1, wherein the colorant is present in an amount of from about 1% by weight to about 15% by weight based upon the total weight of the composition.

29. A developer comprising:

the composition of claim 1; and a carrier.

30. The developer in accordance with claim 29, wherein the developer has a toner charge to mass ratio of from about −25 to about −15 μC/g.

31. The developer in accordance with claim 29, wherein a concentration of the toner of the developer is from about 10 percent to about 3 percent.

32. The developer in accordance with claim 29, wherein the first titanium dioxide is insulative and the second titanium dioxide is moderately conductive.

33. The developer in accordance with claim 29, wherein the first titanium dioxide is an insulative titanium dioxide possessing an average bulk conductivity of less than or equal to about 10E-11 S/Cm.

34. The developer in accordance with claim 29, wherein the first titanium dioxide is an insulative titanium dioxide possessing an average bulk conductivity of about 10E-11 S/cm to about 10E-15 S/cm.

35. The developer in accordance with claim 29, wherein the second titanium dioxide is a moderately conductive titanium dioxide possessing an average bulk conductivity of from about 10E-6 to about 10E-12 S/cm.

36. The developer in accordance with claim 29, wherein the second titanium dioxide is a moderately conductive titanium dioxide possessing an average bulk conductivity of from about 10E-7 to about 10E-10 S/cm.

37. The developer in accordance with claim 29, wherein the additive mixture comprised of a mixture of a first titanium dioxide and a second titanium dioxide is prepared with a ratio of the first titanium dioxide to the second titanium dioxide that is selected based upon a determined charging effect that the carrier of the developer imparts to the toner at a selected concentration of toner to carrier.

38. The developer in accordance with claim 29, wherein the additive mixture comprises from about 8% to about 3% by weight of the composition, of the first titanium dioxide; and further wherein the additive mixture comprises from about 1% to about 4.5% by weight of the composition, of the second titanium dioxide.

39. The developer in accordance with claim 29, wherein the additive mixture is present in an amount of from about 1% by weight to about 10% by weight based upon the total weight of the composition.

40. The developer in accordance with claim 29, wherein the additive mixture is present in an amount of from about 5% by weight to about 8% by weight based upon the total weight of the composition.

41. The developer in accordance with claim 29, wherein the binder is present in an amount of from about 50% by weight to about 98% by weight based upon the total weight of the composition.

42. The developer in accordance with claim 29, wherein the binder is present in an amount of from about 75% by weight to about 95% by weight based upon the total weight of the composition.

43. The developer in accordance with claim 29, wherein the colorant is present in an amount of from about 1% by weight to about 25% by weight based upon the total weight of the composition.

44. The developer in accordance with claim 29, wherein the colorant is present in an amount of from about 1% by weight to about 15% by weight based upon the total weight of the composition.

45. The developer in accordance with claim 29, wherein the carrier is a coated carrier.

46. The developer in accordance with claim 29, wherein the carrier is a coated carrier having a coating selected from the group consisting of polymers, mixture of polymers, fluorocarbon polymers, acrylate polymers, methacrylate polymers, silicone polymers, polyurethanes, conductive components, carbon black, or a combination thereof.

47. The developer in accordance with claim 29, wherein the additive mixture further comprises:

silica dioxide.

48. The developer in accordance with claim 29, wherein the additive mixture further comprises:

a metal salt of a fatty acid.

49. The developer in accordance with claim 29, wherein the additive mixture further comprises:

zinc stearate.

50. The developer in accordance with claim 29, wherein the additive mixture further comprises:

at least one hydrophobic silica optionally present in an amount of from about 1 percent to about 6 percent by weight, based upon the weight of the toner.

51. The developer in accordance with claim 29, wherein the additive mixture further comprises:

at least one hydrophobic silica surface treated with a material selected from the group consisting of a silane, decyltrimethoxysilane, dimethyldichlorosilane, dimethyl polysiloxane, hexamethyldisilazine, amino-silane, and amine.

52. The developer in accordance with claim 29, wherein the second titanium dioxide is surface treated with a silane.

53. The developer in accordance with claim 29, wherein the second titanium dioxide is surface treated with a decylsilane, decyltrimethoxysilane, dimethyldichlorosilane, dimethyl polysiloxane, hexamethyldisilazine, amino silane, i-butyltrimethoxy silane, silicone oil or mixtures thereof.

54. The developer in accordance with claim 29, wherein the first titanium dioxide and the second titanium dioxide comprise titanium dioxide particles having an average primary particle diameter of at least about 10 nanometers to about 100 nanometers.

55. The developer in accordance with claim 29, wherein the toner is generated by emulsion aggregation processes.

56. The developer in accordance with claim 29, wherein the colorant is a pigment, a dye, a mixture of pigments, a mixture of dyes, or a combination thereof.

57. The developer in accordance with claim 29, wherein the colorant is carbon black, cyan, magenta, yellow, blue, or mixtures thereof.

58. The developer in accordance with claim 29, wherein the binder is selected from the group consisting of polyesters, thermoplastic resins, polyolefins, styrene acrylate, styrene butadienes, cross-linked styrene polymers, epoxies, polyurethanes, vinyl resins, polymeric esterificatin products of a dicarboxylic acid and a diol comprising a phenol, and copolymers and mixtures thereof.

59. A toner process comprising:

forming toner particles comprised of polymer binder and colorant; and incorporating a charge control surface additive mixture comprising a mixture of a first titanium dioxide possessing a first conductivity and a second titanium dioxide possessing a second conductivity and which second conductivity is dissimilar than the first conductivity;

wherein the mixture of the first titanium dioxide and the second titanium dioxide is selected in a ratio sufficient to impart a selected triboelectric charging characteristic to the toner composition.

60. The method in accordance with claim 59, wherein forming toner particles is by an emulsion aggregation process.

61. A method for preparing a developer comprising:

determining a charging effect a carrier imparts to a toner composition in accordance with claim 1, at a selected concentration of toner to carrier;

preparing the charge control surface additive mixture, wherein the ratio of the first titanium dioxide to the second titanium dioxide is selected based upon the determined charging effect;

incorporating the additive mixture onto the toner; and mixing the toner and the carrier.

* * * * *